US005249801A

United States Patent [19]

Jarvis

[11] Patent Number: 5,249,801

[45] Date of Patent: Oct. 5, 1993

[54] LOTTERY GAME PLAYER ASSISTANCE METHOD

[75] Inventor: Clay B. Jarvis, Colonial Heights, Va.

[73] Assignee: C&J Concepts Incorporated, Colonial Heights, Va.

[21] Appl. No.: 895,637

[22] Filed: Jun. 9, 1992

[51] Int. Cl.[5] ..... A63F 3/06

[52] U.S. Cl. ..... 273/148 R; 273/139; 283/903

[58] Field of Search ..... 273/138 R, 138 A, 139, 273/240, 148 R; 283/901, 903

[56] References Cited

FOREIGN PATENT DOCUMENTS 2503572 10/1982 France ..... 273/148 R
2553291 4/1985 France ..... 273/148 R
2572298 5/1986 France ..... 273/148 R

OTHER PUBLICATIONS

Virginia Lottery Pick 6.

*Primary Examiner*—Benjamin H. Layno

[57] ABSTRACT

A method for assisting a lottery player to rapidly and accurately identify winning lottery games which includes the use of a playing card where selected numbers from each game is circled in a row containing all the possible numbers for that game with the rows arranged in columns so that each column contains identical numbers. When the winning numbers are drawn they are indicated on the playing card by drawing a line down the column where the number occurs and the readily observable intersection between the drawn line and the encircled selected numbers indicate winning games when the selected numbers and winning numbers intersect in a winning number of instances.

5 Claims, 5 Drawing Sheets

LOTTERY GAME PLAYER ASSISTANCE METHOD

This invention relates to a method and system for assisting a player to rapidly and accurately determine whether or not the player has won the lottery.

Lotteries have become commonplace in many states for the entertainment of the citizens and as a way of obtaining additional revenues for the state. Generally speaking, a player buys a game ticket which has a set of numbers for each game paid for. The player either initially selects the numbers on a play slip or either checks off a box on the play slip or verbally requests the lottery retailer to have the computer make a random choice selection. The play slip is usually in the form of a matrix block or panel of rows and columns of numbers for each game or in some cases a single row for each game. The play slip is turned into the lottery retailer who enters it into computer apparatus or dispenser that automatically reads the selections or the request for random numbers and the apparatus dispenses a game ticket with a set of numbers selected for each of the games. The date and time of playing is also entered on the game ticket. The state or issuing authority periodically has a drawing of winning numbers. Any player that has a game ticket where all of the winning numbers coincide with the preselected set of number for a single game wins a jackpot. If many of the numbers coincide, but not all, a prize may still be won. The process of comparing the winning numbers with the preselected numbers that the player has for his or her individual games is tedious, time consuming and often times error prone.

SUMMARY OF THE INVENTION

The present invention is a new method and system that enables a player to accurately and quickly identify or determine the numbers that coincide and whether he or she has won the lottery. The method and system is carried out by the player entering onto a preprinted play card a set of the selected numbers for each game on a single horizontal row of numbered spaces of the playing card. The horizontal row has all of the numbers normally used in the lottery ascending in numerical order from "1" on the left to the highest number on the right. A number is printed in each space along the row. The number that corresponds with the selected number is either circled or otherwise indicated. There is a different row for each game. The rows which are lined up in vertical columns so all of the numbered spaces in a single vertical column are the same. When the winning lottery numbers are drawn or become available, they are entered into the game card by drawing a vertical line down the column for each of the winning numbers. It is readily apparent to the eye where the winning numbers and the preselected numbers intersect or connect and so the number of winning numbers preselected in a given game is readily determined both quickly and accurately. Because of the speed with which the comparison can be made, it can be simultaneous with the drawing of the winning numbers either by observing on public television, in person, hearing on the radio, or any other form of simultaneous communication of the winning numbers as they are drawn. This makes for a much more interesting and enjoyable game.

BRIEF DESCRIPTION OF THE DRAWINGS

Further understanding of the advantages of the present invention, together with additional features contributing thereto, will be apparent from the following description of the preferred embodiment when read in conjunction with the accompanying drawings wherein.

DETAILED DESCRIPTION OF THE PREFERRED EMBODIMENT

Figure 1:
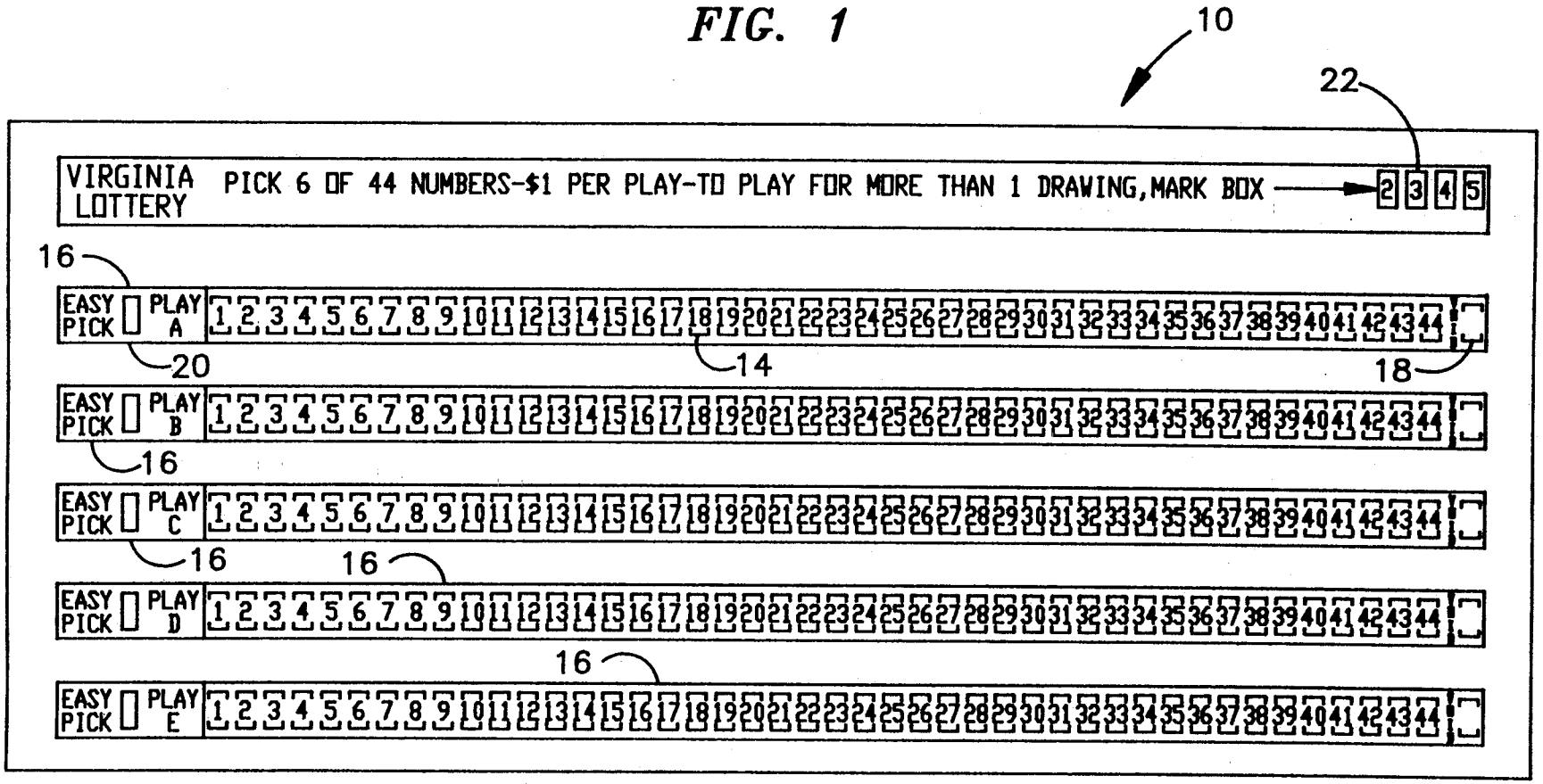
FIG. 1 shows a play slip used by one state that has the numbers to be picked in a horizontal line.
Figure 2:
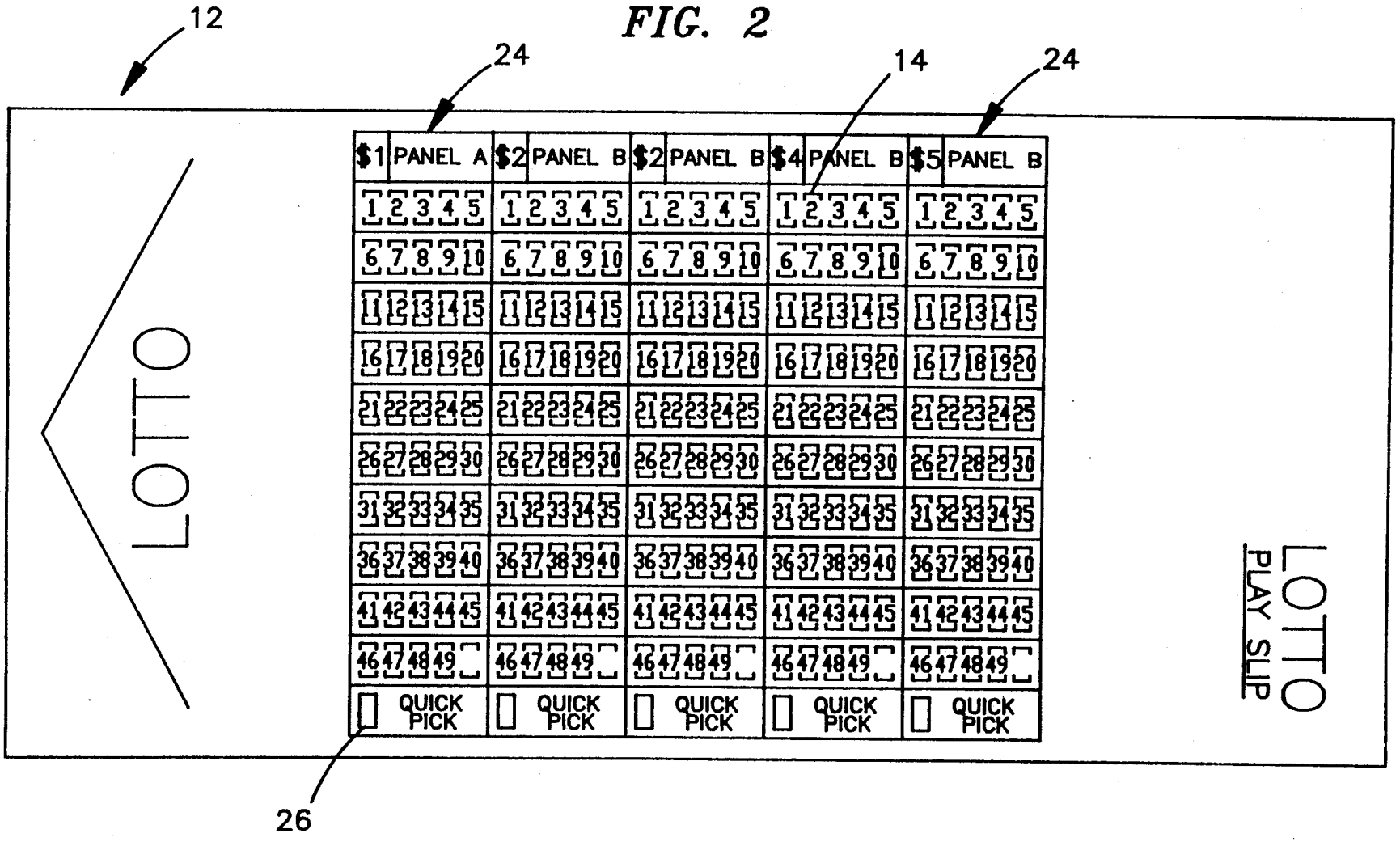
FIG. 2 shows the play slip utilized by another state where the numbers to be selected are in a matrix box of rows and columns.

With reference to FIG. 1, there is shown a play slip 10 used by the State of Virginia and FIG. 2 shows a similar play slip 12 used by the State of Florida. When a player wishes to play the lottery he or she goes to a lottery retailer and either tells the retailer to sell one or more games and have the retailer furnish randomly selected numbers or else presents the retailer with one or more of the play slips such as 10 or 12 which has been filled out to either indicate the selected numbers or a desire that the retailer select the numbers randomly. If the play slip is used such as in FIG. 1 and 2, then the player marks each one of the numbered boxes or spaces 14 for each one of the games that are being played. For example, in FIG. 1 playing the Virginia lottery with five games would mean that each row 16 entitled "Play A", "Play B", "Play C", "Play D", and "Play E" would be filled in. This represents five individual games at a cost of a dollar a piece. For example, with respect to "Play A" six of the numbers would be selected by the player and marked in with a pencil or pen using blue or black ink only. If a mistake is made, then the last box or space 18 entitled "Void" can be filled in. If it is desired by the player that rather than preselecting six numbers, the retailer selects the numbers a random choice from the dispenser then the box entitled "Easy Pick" 20 is filled in. If the player desires that the chosen numbers be repeated on future drawings of the lottery, this may be done by marking "2", "3", "4", or "5", depending on the number of repeats, the space or box 22 in the upper right hand corner of the play slip.

It is to be noted that the numbers run from one to forty-four in the Virginia lottery and six numbers are chosen.

With respect to the Florida lottery play slip 12 that is shown in FIG. 2, the numbers to be selected run from one to forty-nine and each game is in the form of a matrix of spaces or boxes arranged in rows and columns in a block or panel 24 marked "Panel A", "Panel B", "Panel C", "Panel D", and "Panel E". The Quick Pick box 26 at the bottom of each panel is used when the player desires that the retailer use the dispenser to randomly select the numbers for the player. This is the same as the Easy Pick used in Virginia. Again, six numbers for each game is chosen. If "Advance Play" on boxes 28 the left side of the play slip 12 is filled in, the selected numbers will be repeated in future drawings.

Figure 3:
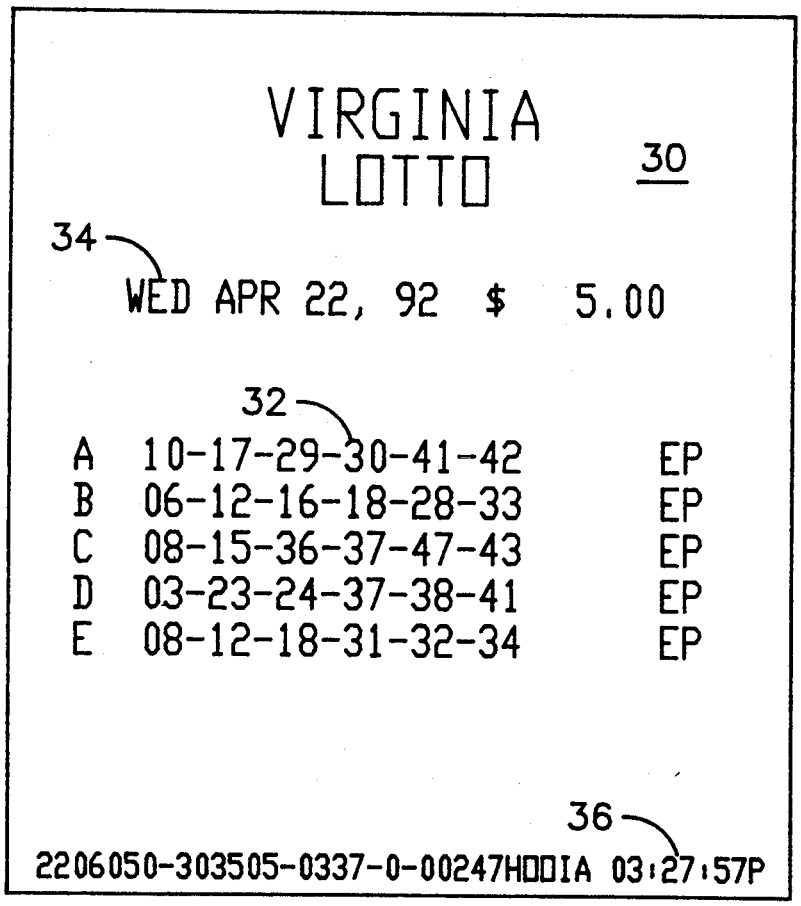
FIG. 3 is a ticket issued by the computer apparatus or dispenser used by the sales clerk.

The lottery retailer either uses the dispenser to select the numbers randomly for the player when this is verbally requested or else feeds the play slip into the computer apparatus used as a dispenser which automatically reads the play slip and issues a game ticket 30 such as shown in FIG. 3. The game ticket of FIG. 3 was issued for five games "A", "B", "C", "D", and "E" and the six selected numbers 32 for each set of numbers used in each game was randomly picked by the computer. The game ticket 30 has a date 34 and time 36 which shows it was issued at 3:27:57 p.m. on Wednesday, Apr. 22, 1992 and five dollars was received. Also, in this particular instance, a free ticket for a Cash Vault was won but this is just an added bonus and has nothing to do with the present invention.

Figure 4:
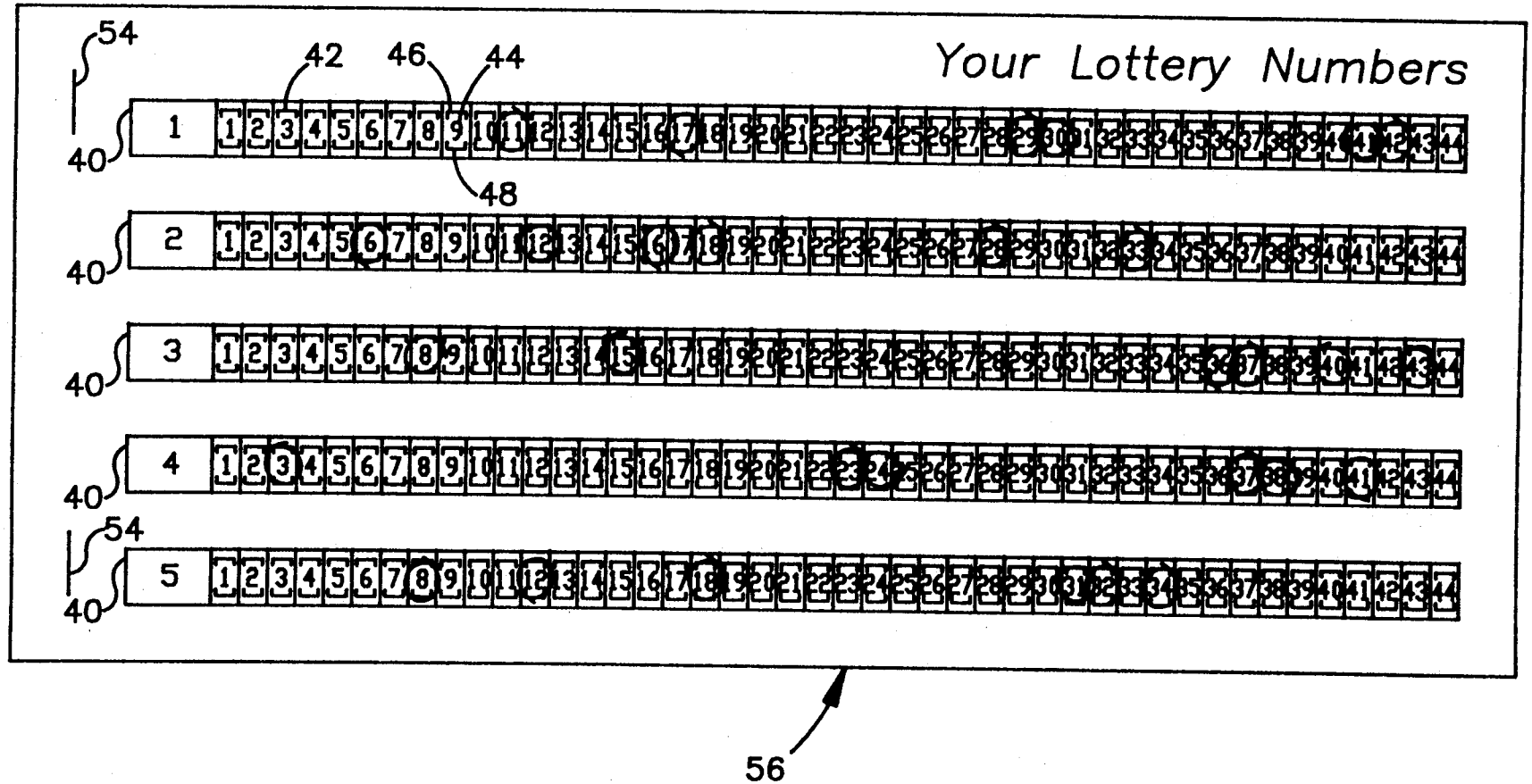
FIG. 4 is a blank playing card in which the selected numbers have been circled.

With reference to FIG. 4, there is shown a playing card utilized with the present invention. It has spaces for five games "1", "2", "3", "4" and "5" arranged in a row 40 associated with each game. The lottery numbers are in ascending numerical order starting with "1" on the left and increases to the right to encompass all the numbers played in the lottery. In this case there are forty-four numbers provided but this would be increased in those lotteries that have higher numbers and decreased in those lotteries that have lower numbers.

Each of the preprinted numbers 44 one through forty-four occupy a space 42 and two U-shaped brackets 46 and 48 that surround each of the numbers. The spaces are uniformly distant from one another. The remaining games after game "1" have an identical row of numbers arranged underneath the first game so that all of the same numbers line up vertically in the same column. Thus, there is provided a matrix of spaces in a row and a column format with each row representing a game and each column representing the same number in that game.

When the player receives the game ticket 30 the selected numbers shown thereon are entered onto the playing card. As shown in FIG. 4, all of the numbers which had been selected as shown on the game ticket 30 of FIG. 3 are encircled. Encircling with a pen or pencil is the best way to indicate the selected numbers but they also may be shown by an X or other similar marking. As indicated in game "1" which is "A" on the game ticket 30 of FIG. 3, the numbers "10", "17", "29", "30", "41", and "42" have all been circled. Likewise, the corresponding numbers have been circled on games "2", "3", "4", and "5" of the playing card 38 to correspond respectively to the selected numbers of game "B", "C", "D", and "E" on the game ticket 30.

In the case of Virginia, the drawing of the winning lottery numbers is made on public television twice a week enabling the lottery players to view the actual drawing. This makes it much more interesting and exciting for players. The six numbers drawn are drawn randomly. They are publicized also in newspapers and at each of the lottery retailers. It lends added excitement to the game if the winning numbers that are being drawn are entered on the playing card 38 as they are drawn as this build up to the excitement as to whether or not or to what the extent last numbers drawn will result in a win.

Figure 5:
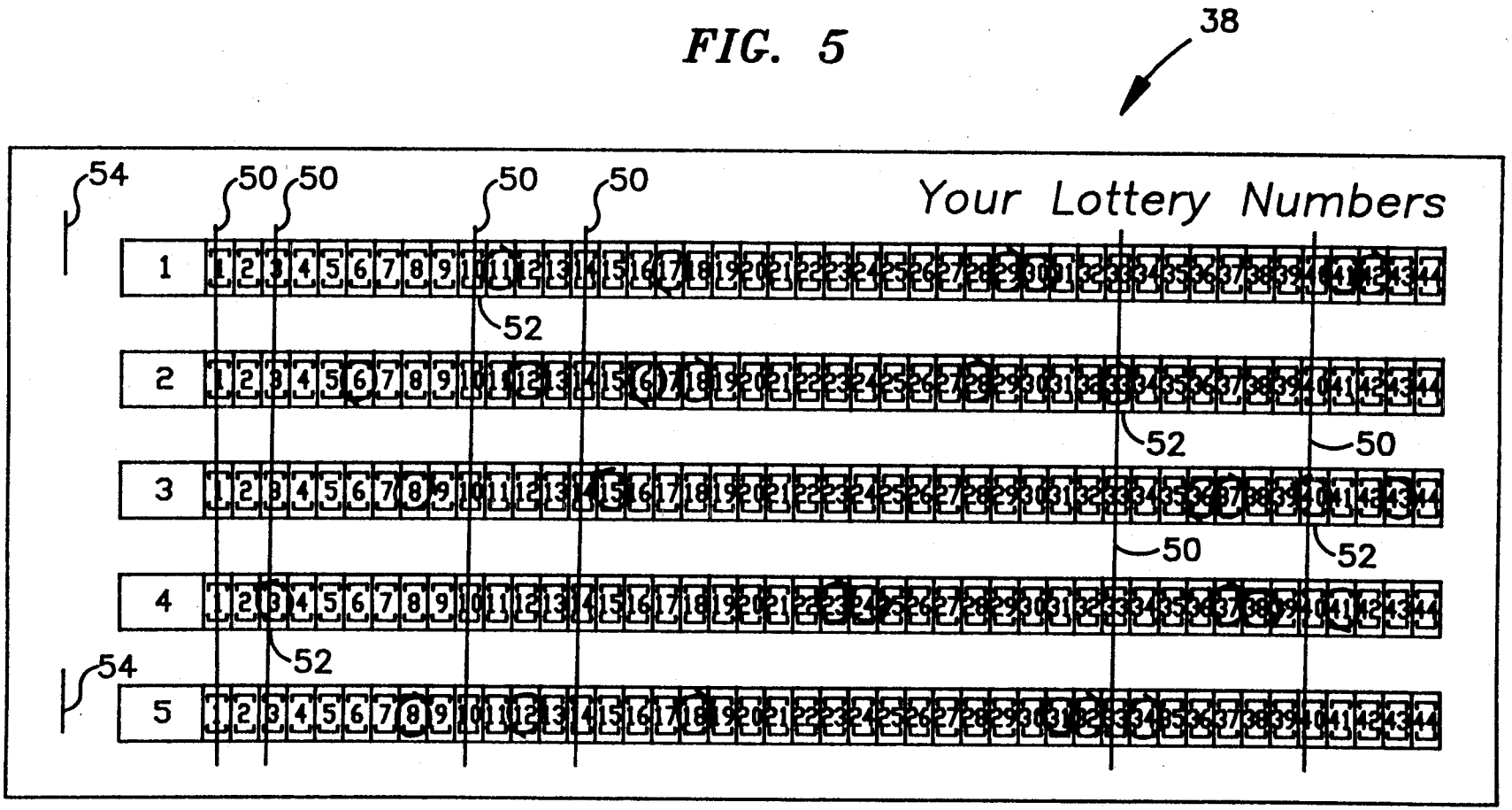
FIG. 5 is the playing card of FIG. 4 in which the winning numbers have been inserted onto the playing card by drawing a continuous vertical line through each of the winning numbers.

The winning numbers are entered onto the playing card as shown in FIG. 5 by drawing a connecting line 50 down the drawn winning number column. In this case the winning numbers of this particular drawing were "1", "3", "10", "14", "33", and "40". Of course, the numbers were not drawn in this sequence but would have been randomly drawn. As quickly and accurately seen from looking at FIG. 5, the winning intersections or winning connects 52 in the various games show that in game "1" only the number "10" was both a winning number and a selected number. In game "2" only the number "33" was both a winning number and selected number. In game "3" only number "40", in game "4" only number "3", and in game "5" no numbers were both selected numbers and winning numbers. Then, no game was a winner in FIG. 5. Six numbers in a single game coinciding would have been a jackpot winning millions of dollars. Even if six winning numbers do not correspond to six selected numbers in an individual game, the player may still win if he or she hits three, four or five winning numbers that correspond to the selected numbers. Of course, the wins decrease with the smaller the number.

With reference to FIGS. 4 and 5, there are two staples 54 shown on the left side. The playing cards 38 are obtained in a pack which are held together by staples or adhesive or some similar method. The playing cards can be made from normal white paper of standard writing weight but are preferably made from a translucent paper which can be placed over a similar card or page when a duplicate selection of numbers is desired.

As shown in FIGS. 4 and 5, preferably each game is in a separate row with the numbers in that lottery running from one to the maximum numbers from left to right and the subsequent games are arranged in other rows so that they line up into columns with all the numbers in each column being identical. However, this could be reversed so that the numbers run from top to bottom of a single column representing a game and the rows all having the same number with each column representing a separate game. In this case the connecting line of the winning numbers would be a horizontal line rather than a vertical line.

The above method and system used in checking the numbers results not only in an accurate determination of any winning games but does so very rapidly. In one test the determination for five games was made in 30 seconds whereas a single determination using old techniques took far longer and because of the inaccuracy, required additional time for repeated checking and rechecking.

While the present instant invention has been shown and described herein in what has been conceived to be the most practical and preferred embodiment, it is recognized that departures may be made therefrom within the scope of the invention which, therefore, is not to be limited to the details disclosed herein, but is to be accorded the full scope of the claims so as to embrace any and all equivalent methods and systems.

What is claimed is:

1. A method for assisting a player to identify winning lottery numbers accurately and quickly comprising the following steps:

selecting a multiple set of numbers, one set for each of a plurality of lottery games, with each set representing a different game;

obtaining a playing card having all of the lottery numbers printed thereon in numerical sequence in a single line to define either a horizontal row or a vertical column, said playing card having repetitive rows or columns defining an array of spaces each representing a separate number of said line of lottery numbers with each row or column representing a different game;

entering said selected numbers of each set onto said playing card by making a mark in the vicinity of said space of a number corresponding to said selected numbers in a single row or column for each set;

obtaining the set of winning lottery numbers;

drawing a line on said playing card for each winning lottery number which line generally connects all the corresponding spaces for winning lottery numbers in each column or row; and determining the number of intersections between the drawn line and said spaces that were marked with said selected number.

2. The method of claim 1 wherein said playing card has said line of lottery numbers in said horizontal row and each vertical column is made of the same numbers from different games.

3. The method of claim 2 wherein each of said spaces contains a lottery number preprinted thereon.

4. The method of claim 3 wherein said playing cards are obtained as a booklet of a multiplicity of playing cards bound together.

5. The method of claim 2 wherein each of said spaces contains a lottery number preprinted thereon partially surrounded by at least one U-shaped bracket.

* * * * *